United States Patent [19]

Hung et al.

[11] Patent Number: 4,681,383

[45] Date of Patent: Jul. 21, 1987

[54] RESILIENT SEALING DEVICE FOR TELEPHONE SUBSCRIBER TERMINALS

[75] Inventors: Peter Hung, Wheatley Heights; Paul V. De Luca, Plandome Manor, both of N.Y.

[73] Assignee: Porta Systems Corp., Syosset, N.Y.

[21] Appl. No.: 856,022

[22] Filed: Apr. 25, 1986

[51] Int. Cl.[4] ..... H01R 13/44

[52] U.S. Cl. ..... 439/135

[58] Field of Search ..... 339/36, 39, 60 R

[56] References Cited

U.S. PATENT DOCUMENTS

| | | | |
|---|---|---|---|
| 2,694,796 | 11/1954 | Cole | 339/60 R |
| 3,359,526 | 12/1967 | Bakker | 339/60 R |
| 3,508,291 | 4/1970 | Klebe, Jr. | 339/36 |
| 3,755,615 | 8/1973 | Paullus et al. | 339/102 R |
| 4,531,800 | 7/1985 | Avener | 339/39 |
| 4,624,516 | 11/1986 | White | 339/36 |

*Primary Examiner*—Gil Weidenfeld
*Assistant Examiner*—Paula A. Austin
*Attorney, Agent, or Firm*—Charles E. Temko

[57] ABSTRACT

A moulded resilient sealing device adapted to close the exposed opening in a telephone subscriber jack to prevent entry of moisture, vermin and the like. The device includes a cap-like body having a continuous peripheral edge which contacts a planar surface surrounding the plug opening, and a smaller opening at an opposite end thereof which resiliently clamps a flattened cable leading to subscriber equipment, such as a telephone handset at one end and a corresponding plug engaging jack at an opposite end. The opening is shiftable along the cable to increase the resilient force applied to the peripheral edge. The edge is also reinforced along one rectilinear side to prevent distortion by contact with the release lever of the plug, and accomodate for commerical manufacturing tolerances encountered in jacks of different manufacture.

3 Claims, 3 Drawing Figures

RESILIENT SEALING DEVICE FOR TELEPHONE SUBSCRIBER TERMINALS

BACKGROUND OF THE INVENTION

This invention relates generally to the field of telephony, and more particularly to an improved resilient sealing device adapted to close the opening in a wall mounted jack surrounding an engaged type RJ11 plug.

With the advent of subscriber owned telephone equipment, notably hand sets and the like, there has arisen a need for providing for the convenient interconnection and disconnection of such equipment, which has been satisfactorally accommodated by the now commonplace RJ11 jack and plug construction.

Because of the necessity of providing clearance in the jack opening for manipulation of the laterally extending disconnect lever which forms a part of the plug, it is normally not possible to completely seal the opening in the jack by the mere insertion of the plug. Where the jack is, as is normally the case, positioned near a floor area in a room, the entrance of moisture, dirt and vermin, is normally only a question of time after installation.

SUMMARY OF THE INVENTION

Briefly stated, the invention contemplates the provision of a moulded relatively flexible sealing device of cup-shaped configuration having a first end defining a sealing lip which completely surrounds the opening in the RJ11 plug and its normally laterally projecting release lever; and having an oppositely disposed outer end wall portion of thickened cross section and defining a resiliently contractable funnel-shaped opening adapted to clamp the flattened four conductor cable which is carried by the RJ11 plug. The opening is slidably adjustable upon the cable to vary the effective resilient force applied to the lip. An area of increased thickness is provided on one wall thereof, which overlies the projecting end of the lever to prevent distortion of the seal when in installed condition, when used with plugs of varying manufacture.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
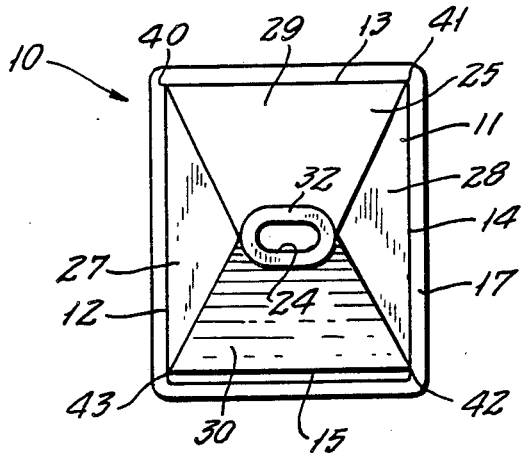
FIG. 1 is an outer end elevational view of an embodiment of the invention.
Figure 2:
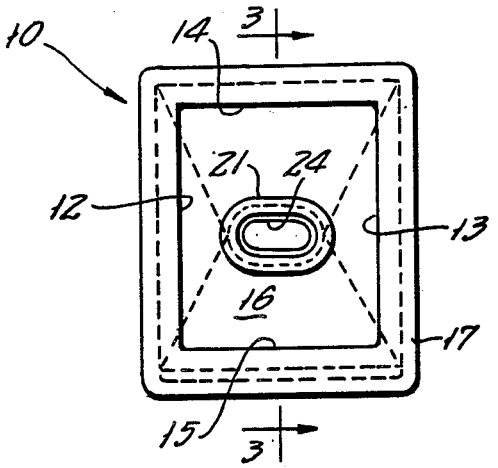
FIG. 2 is a second end elevational view thereof showing the end opposite that seen in FIG. 1.
Figure 3:
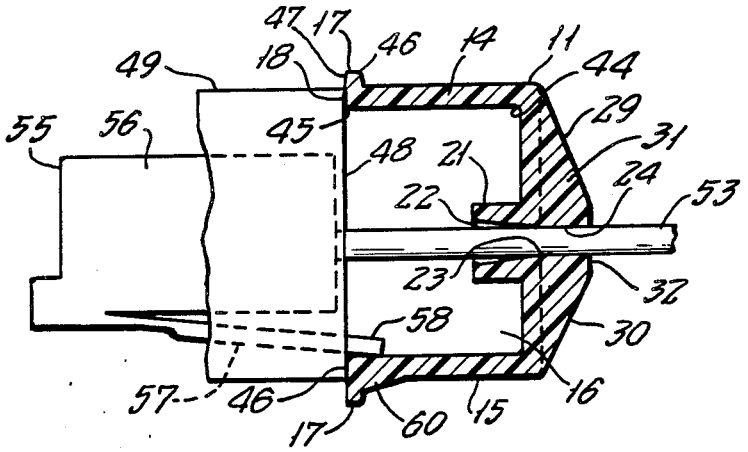
FIG. 3 is a longitudinal central sectional view thereof showing the device in installed condition.

In accordance with the invention, the device, generally indicated by reference character 10 is most conveniently formed as a unitary moulding of silicone rubber or similar material. It includes an outer wall element 11, wider side walls 12 and 13 and relatively narrower side walls 14 and 15 forming a hollow void 16 bordered at one end thereof by continuous peripheral flange member 17 projecting laterally from a free edge 18.

The outer wall element 11 is of irregular cross section, and includes a generally planar inner surface bordering a funnel-shaped ovate flange 21. The flange surrounds a tapered opening 22 converging to a point 23 where it communicates with a rectilinear ovate bore 24 terminating at an outer surface 25. As best seen in FIG. 1, the surface 25 includes a pair of triangularly-shaped planar portions 27 and 28 which merge with a pair of trapazoidally-shaped portions 29 and 30. The portions 29 and 30 are of tapered cross section as indicated by reference character 31, and meet at an oval-shaped plateau 32 which surrounds the rectilinear bore 24.

The side walls 12 to 15, inclusive, interconnect at generally parallel longitudinal edges 40, 41, 42 and 43. They are bordered by continuous edges 44 and 45, the edge 45 forming the inner border of a continuous flange 46 which forms a sealing surface 47 which bears upon a surface 48 surrounding the opening in a plug 49.

As is known in the art, the RJ11 plug 55 includes a main plug body 56 and a disengagement lever 57, the outer end 58 of which projects outwardly of the plug opening. To prevent distortion of the device 10 when in sealing engagement, an additional area 60 is provided on the wall 15 which exerts a light resilient force against the levers 57 which is insufficient to cause disengagement.

The device 10 is installed by inserting a free end of the subscriber cable 53 through the contractile opening 23, and sliding the same to a point where it overlies the plug body 56. When the associated equipment is connected to the corresponding jack, the flange 47 will normally abut the exposed surface of the jack body to effect the desired sealing action. The force with which the flange 47 is pressed against the jack may be increased by sliding the outer wall element 11 along the cable to impart a slight compressive force to the side walls 12–15. When it is desired to disconnect the plug from the jack, it is necessary only to squeeze the device between the forefingers of the user, at which time force may be applied to the disconnect lever through the wall 15.

We wish it to be understood that we do not consider the invention limited to the precise details of structure shown and set forth in this specification, for obvious modifications will occur to those skilled in the art to which the invention pertains.

We claim:

1. An improved resilient sealing device for closing an opening in an exposed surface of a plug body which accommodates a jack body, the jack body having a laterally extending manually engageable release lever comprising: a moulded body having a principal axis of resilient material including a transversely extending outer wall element and a plurality of side wall members extending longitudinally from said outer wall element to define a generally rectangular void; said side wall elements terminating in a continuous free edge having a laterally extending continuous sealing flange thereon; said outer wall element having an inner planar surface, and a cross section which varies in thickness to be most thick at the geometric center thereof, and having a continuous through ovate bore extending from said inner planar surface to an oppositely disposed outer surface thereof for selectively clamping a surface of a flattened cable interconnecting with said plug body; whereby, upon the engagement of said jack body within said plug body, said device may be moved along said cable to create a compressive force at said laterally extending flange resulting in a sealing action.

2. A device as set forth in claim 1, characterized in one of said side walls having an area of increased thickness adjacent a segment of said laterally extending flange and adapted to overlie a free end of said release lever of said jack body when in installed condition to prevent lateral distortion of said side wall.

3. A device as set forth in claim 1, further characterized in said inner surface of said outer wall element having a funnel-shaped flange thereon leading to said ovate through bore to facilitate insertion a free end of said cable.

* * * * *